US005114254A

United States Patent [19]

Sato et al.

[11] Patent Number: 5,114,254

[45] Date of Patent: May 19, 1992

[54] RIBBON CASSETTE HAVING MEANS TO FEED BOTH FABRIC AND FILM RIBBONS

[75] Inventors: Hiroyuki Sato; Mikishige Sugasa, both of Tokyo, Japan

[73] Assignee: Seikosha Co., Ltd., Tokyo, Japan

[21] Appl. No.: 492,706

[22] Filed: Mar. 13, 1990

[30] Foreign Application Priority Data

Mar. 13, 1989 [JP] Japan ..... 1-60252

[51] Int. Cl.[5] ..... B41J 35/28

[52] U.S. Cl. ..... 400/207; 400/227.2; 400/195; 400/196.1

[58] Field of Search ..... 400/195, 196, 196.1, 400/207, 194, 227.2

[56] References Cited

U.S. PATENT DOCUMENTS 3,989,132 11/1976 Carson, Jr. ..... 400/195
4,293,234 10/1981 Yonkers et al. ..... 400/195
4,645,364 2/1987 Ohsaki ..... 400/248
4,988,224 1/1991 Furrow et al. ..... 400/194

*Primary Examiner*—Edgar S. Burr
*Assistant Examiner*—John S. Hilten
*Attorney, Agent, or Firm*—Jordan and Hamburg

[57] ABSTRACT

A ribbon cassette used for both a fabric ribbon and a film ribbon has a first slit through which a fabric ribbon is passed and a second slit through which a film ribbon is passed, the slits being provided in a wall member which partitions a downstream end of a ribbon storage chamber for storing an endless ink ribbon in a meandering state. The second slit is disposed upwardly of the first slit, and a rib for applying a load to the travel of the fabric ribbon is formed on a bottom surface in the vicinity of the upstream side of the first slit at the same position as the second slit or downstream thereto. The second slit is provided at a position biased in a direction opposite to a projecting direction of the pull-out arm and the pull-in arm from the transversely central position of the ribbon storage chamber.

26 Claims, 1 Drawing Sheet

RIBBON CASSETTE HAVING MEANS TO FEED BOTH FABRIC AND FILM RIBBONS

BACKGROUND OF THE INVENTION

The present invention relates to a ribbon cassette loaded on a printer.

Conventionally, an endless ink ribbon is stored in a ribbon cassette in a meandering state, and printing is effected by means of a print head of a printer by feeding the ink ribbon intermittently to a front surface of a platen. As regards ink ribbons, two types are available, one type being generally called a film ribbon and the other a fabric ribbon. Special ribbon cassettes that are adapted for the respective types have been specially used for the following reasons.

A fabric ribbon utilizes a fabric, i.e. a basic material impregnated with printing ink. A film ribbon utilizes a synthetic resin film as a basic material and ink is applied to one side of the film. The film ribbon is harder than the fabric ribbon since it uses a synthetic resin film as a basic material.

In addition, in the case of a ribbon cassette for a fabric ribbon, when the fabric ribbon is drawn out from a ribbon storage chamber in which the ribbon is stored in a meandering state, the ribbon enters a slit in a bent state provided in a wall member for partitioning the downstream side of the ribbon storage chamber, possibly resulting in jamming with the ribbon at the slit.

Hence, in order to draw out the ribbon smoothly from the ribbon storage chamber, an arrangement is provided such that a rib or projecting portion and the like are formed in the vicinity of the exit of the ribbon storage chamber so that the ribbon is drawn out properly by imparting sliding resistance to the ribbon, i.e., by applying a load to the travelling ribbon (e.g., U.S. Pat. No. 4,645,364).

In the case of a film ribbon, however, since the basic material is harder, if the aforementioned rib or the like is formed in the vicinity of the slit of the ribbon storage chamber, the rib hampers the passage of the film ribbon.

Consequently, as regards ribbon cassette cases, a case for the fabric ribbon and a case for the film ribbon have been separately required in the conventional art. For this reason, separate molds for forming them are required, thereby increasing production costs.

SUMMARY OF THE INVENTION

Accordingly, an object of the present invention is to provide a ribbon cassette used for both a fabric ribbon and a film ribbon in order to lower production costs.

A first feature of the present invention resides in that a first slit through which a fabric ribbon is passed and a second slit through which a film ribbon is passed are provided in a wall member which partitions a downstream end of the ribbon storage chamber for storing an endless ink ribbon in a meandering state, the second slit being disposed upwardly of the first slit, and a rib for applying a load to the travel of the fabric ribbon is formed on a bottom surface in the vicinity of the upstream side of the first slit at the same position as the second slit or downstream thereto.

A second feature of the present invention resides in that the second slit is provided at a position biased in a direction opposite to a projecting direction of the pull-out arm and the pull-in arm from the transversely central position of the ribbon storage chamber.

DESCRIPTION OF THE PREFERRED EMBODIMENTS

Referring now to the accompanying drawings, a detailed description of the present will now be set forth.

Figure 1:
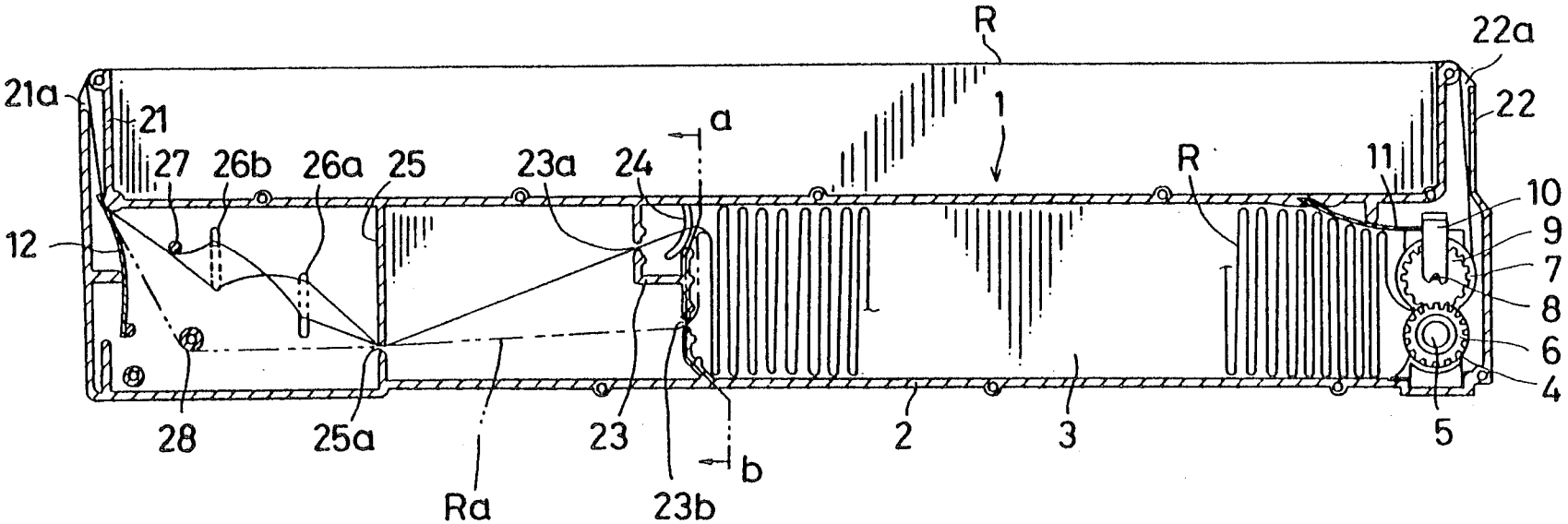
FIG. 1 is a cross-sectional view of a ribbon cassette according to one embodiment of the invention.

In FIG. 1, an oblong ribbon storage chamber 3, which occupies a rightward more-than-half portion of a case 2 of a ribbon cassette 1, is formed in the case 2 of ribbon cassette 1. An ink ribbon R is stored in this ribbon storage chamber in a meandering state. A pull-out arm 21 and a pull-in arm 22 are respectively formed integrally on opposite end portions of the case 2 on side surfaces thereof in such a manner as to project in the same direction. The pull-out arm 21 is provided with an opening 21*a* through which the ink ribbon R is drawn outside, while the pull-in arm is provided with an opening 22*a* through which the ink ribbon drawn outside is pulled into the ribbon storage chamber 3.

Furthermore, a driving means is provided for feeding the ink ribbon R (R generally refers to an ink ribbon, but is later also used to refer to a fabric ribbon) from the case 2 and drawing it into the case. The arrangement of this driving means is such that a shaft 5 of a ribbon feed roller 4 is pivotally supported at a lower portion of the right end of the bottom of the case 2 with the shaft 5 passing through the bottom. A gear 6 is secured to this roller 4 coaxially therewith, and a pressing roller 7 resiliently abuts against the roller 4. A lower end of a shaft 8 of the pressing roller 7 fits in a non-illustrated guide groove formed in a bottom surface of the case 2, and a gear 9 is provided on an upper surface of the roller 7 coaxially with the roller 7, an upper end of the shaft 8 being borne by a slider 10. Coupled with the slider 10 is a distal end of a resilient plate 11 having its proximal end secured to the case 2. Consequently, the pressing roller 7 imparts a pressing force to the ribbon feed roller 4, and the gear 6 is positively interlocked with the gear 9 by meshing therewith. In addition, the lower end of the shaft 5 of the ribbon feed roller 4 is inserted through and projects from the bottom of the case 2, as described above, and a rotatively driving force from a drive motor is imparted thereto.

A wall member 23 which partitions the downstream side of the ribbon storage chamber 3 for the ink ribbon R has its upper half formed into a configuration in which it projects leftward (toward the downstream side). A first slit 23*a* is provided in this projecting wall surface, and a second slit 23*b* is provided in a lower right (on the upstream side) portion of the wall member 23.

Figure 2:
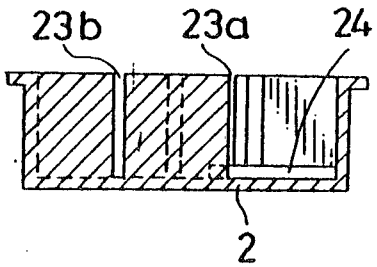
FIG. 2 is a cross-sectional view taken along the line a–b of FIG. 1.

Specifically, the second slit 23*b* is provided at a position biased in a direction opposite to the projecting direction of the pull-out arm 21 and the pull-in arm 22 (i.e., downwardly in FIG. 1, from the transversely central position of the ribbon storage chamber 3. The specific configurations of these slits 23*a*, 23*b* are apparent from FIG. 2. The first slit 23*a* is for the fabric ribbon, while the lower second slit 23*b* is for the film ribbon.

The fabric ribbon R is drawn out from the first slit 23*a*, A rib 24 is projectingly provided on the bottom of the case 2 in the vicinity of the upstream side of the first slit 23*a*. The arrangement is such that the rib parts sliding resistance to the travel of the fabric ribbon and the ribbon is drawn out smoothly by virtue of this load. As for the position of the rib 24, the rib 24 needs to be spaced apart from the feeding path of the film ribbon so that the rib 24 is located at the same position as the second slit 23*b* or on the downstream side thereof.

In addition, a second wall 25 is disposed midway between the wall member 23 of the ribbon storage chamber and a lefthand hand side wall of the case 2. A slit 25*a* is formed in this wall In a chamber on the lefthand side of this wall, guides 26*a*, 26*b* for forming a mobius strip as well as a guide pin 27 are projectingly formed for the fabric ribbon. A guide pin 28 for the film ribbon is formed below the guide pin 27. A distal end of a resilient plate 12 resiliently abuts against a corner surface of a projecting corner portion of the pull-out arm 21.

The operation of the present invention will now be described.

First, a description will be set forth wherein the ribbon cassette 1 is used for the fabric ribbon R.

The ribbon feed roller 4 and the pressing roller 7 are interlinkingly rotated by the driving of the drive motor. Consequently, the ribbon R passes through the pull-in arm 22 at the opening 22*a* for pulling in the ribbon, then passes between the ribbon feed roller 4 and the pressing roller 7, and is stored in the ribbon storage chamber 3. At the same time, the ribbon R is pulled out through the first slit 23*a* of the ribbon storage chamber 3, and at that time the ribbon R passes while being subjected to load by rib 24. After having emerged from the slit 23*a*, the ribbon R passes through the slit 25*a* in the wall 25, is inverted by the guides 26*a*, 26*b* for forming a mobius strip, and is pulled out through the opening 21*a* of the pull-out arm 21 while being subjected to a pressing force by means of the resilient plate 12.

A description will now be set forth of a case wherein the ribbon cassette 1 is used for a film ribbon Ra shown by the broken line in FIG. 1.

The driving means is similar to that for the fabric ribbon R, but when the ribbon Ra stored in the ribbon storage chamber 3 is pulled out through the second slit 23*b*, and when the ribbon is drawn out through this slit from inside the ribbon storage chamber, the ribbon is not brought into contact with the rib 24, so that the ribbon is pulled out smoothly through the slit 23*b*.

Figure 3:
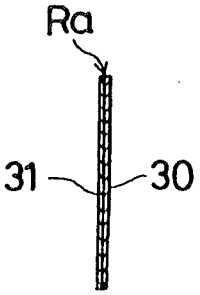
FIG. 3 is a cross-sectional view of a film ribbon.

In addition, as shown in FIG. 3, the film ribbon Ra has an ink layer 31 formed on a film 30 by appling ink to one surface thereof. When stored in the ribbon storage chamber 3, the ribbon Ra is stored with the film surface 30 facing upwardly and the ink layer 31 located on the lower side. In addition, as described above, the second slit 23*b* is located at a position biased downwardly from the transversely central position of the ribbon storage chamber 3.

Accordingly, when the ribbon Ra is drawn out through the second slit 23*b* as shown in FIG. 1, the ribbon is lowered from the leftward end inside the ribbon storage chamber 3, i.e., from the upper right-hand side of the wall member 23 and is bent in the direction of this slit. When passing through this slit 23*b*, the ribbon Ra is pulled out in a state in which only the film surface of this ribbon slides against an opening edge (upper edge in FIG. 1) of this slit. Consequently, the surface of the ink layer 31 is not brought into contact with the opening edge of the slit 23*b*, and the ink layer is therefore protected.

However, in a state in which the ribbon Ra is raised from the lower portion of the ribbon storage chamber 3 and is bent, and enters through the second slit 23*b*, the ribbon is pulled out with the ink layer 31 of the ribbon sliding against the surface of the opening edge (lower edge in FIG. 1) of the slit. Hence, the ink layer 31 is brought into contact with and slide against the opening edge of this slit. However, since this slit is located at the aforementioned biased position, the range of the ribbon Ra moving in this abutting state is very narrow, and the ribbon immediately shifts to a state in which it is lowered from above, and assumes its state in which it is pulled out through the second slit 23*b*.

As shown by the broken lines, the ribbon Ra after having been thus pulled out passes through the slit 25*a*, is guided by the guide pin 28, is pressed by the resilient plate 12, is pulled outside through the opening 21*a* of the pull-out arm 21, and is guided toward a platen so as to be used for printing.

Since the ribbon cassette in accordance with the present invention has the above-described arrangement, when the ribbon of the invention is a fabric ribbon, a load is applied to travel of the ribbon by the rib so that the ribbon is pulled out smoothly through the first slit. On the other hand, when this invention is used for a film ribbon, since the ribbon is not brought into contact with the rib, the ribbon is pulled out smoothly through the second slit. In addition, since the ribbon cassette can be used jointly for both types of ribbons, the present invention is effective in lowering production costs. Furthermore, since the surface of the ink layer of the film ribbon has a short surface which is brought into contact with the second slit, the extent to which the ink layer of the ribbon wears can be reduced.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

What we claim is:

1. A ribbon cassette useable for both a fabric ribbon and a film ribbon, said cassette including means enabling said cassette to be used with either a fabric ribbon or a film ribbon without modification of the cassette, said means comprising a case having a ribbon inlet opening and a ribbon outlet opening for a fabric ribbon and a film ribbon, a ribbon storage chamber storing an endless fabric ribbon and film ribbon in a meandering state, said storage chamber having a downstream wall means, first slit means in said wall means for a fabric ribbon, a second slit means in said wall means for a film ribbon, said first slit means being spaced from said second slit means, a rib means on said case juxtaposed to said first slit means for applying a load to said fabric ribbon as said fabric ribbon passes from said storage chamber, and ribbon handling means disposed between said wall means and said ribbon outlet opening for said fabric ribbon and said film ribbon such that the same cassette is useable for both a fabric ribbon and a film ribbon without modification of the cassette.

2. A ribbon cassette according to claim 1, wherein said case has an elongate wall from which said wall means extends, said rib means extending from said elongate wall.

3. A ribbon cassette according to claim 1, wherein said case has a downstream end and an upstream end, said first slit means being closer to said downstream end than said second slit means.

4. A ribbon cassette according to claim 1, wherein said case has a downstream end and an upstream end, said rib means and said second slit means being substantially equally spaced from said downstream end.

5. A ribbon cassette according to claim 1, wherein said case has a downstream end and an upstream end, said rib means being disposed closer to said downstream end than said second slit means.

6. A ribbon cassette according to claim 1, wherein said wall means has first and second parallel wall portions joined to a third wall portion, said first and second wall portions extending generally perpendicular to said third wall portion, said first slit means being disposed in said first wall portion, said second slit means being disposed in said second wall portion.

7. A ribbon cassette according to claim 1, wherein said case has two generally parallel elongate walls, said wall means extending transversely of said elongate walls, said rib means extending from one of said elongate walls.

8. A ribbon cassette according to claim 1 further comprising pressing means disposed juxtaposed to and upstream of said outlet opening, said pressing means resiliently pressing against a casing part, said fabric ribbon and said film ribbon passing between said pressing means and said casing part.

9. A ribbon cassette according to claim 1, wherein said case has a downstream end at which a pull-out arm is disposed and an upstream end at which a pull-in arm is disposed, said wall means having a first portion and a second portion delineated by a transverse plane extending between said downstream and upstream ends and bisecting said storage chamber, said second slit means being located in said second portion of said wall means.

10. A ribbon cassette according to claim 9 wherein said first slit means is located in said first portion of said wall means.

11. A ribbon cassette according to claim 1, wherein said case has a second wall means downstream of the first said wall means, said second wall means having a third slit means, said fabric ribbon and said film ribbon passing to said third slit means.

12. A ribbon cassette according to claim 11, wherein said case has two parallel elongate walls defining part of said storage chamber, the first said wall means and said second wall means extending generally transversely between said elongate walls.

13. A ribbon cassette according to claim 11 further comprising a resilient tensioning means disposed downstream of said third slit means, said resilient tensioning means applying a tension to said fabric ribbon and said film ribbon.

14. A ribbon cassette according to claim 1 further comprising tensioning means disposed juxtaposed to and upstream of said outlet opening, said tensioning means tensioning said fabric ribbon and said film ribbon.

15. A ribbon cassette according to claim 14, wherein said tensioning means comprises a resilient plate.

16. A ribbon cassette according to claim 14, wherein said case has a guide disposed downstream of said first and said second slit means, said fabric ribbon passing from said first slit means to said guide, said film ribbon passing from said second slit to said guide.

17. A ribbon cassette according to claim 16, wherein said case comprises inverter means disposed between said guide and said tensioning means, said fabric ribbon passing from said guide to said tensioning means via said inverter means, said guide being designated a first guide, said case having a second guide, said film ribbon passing from said first guide to said tensioning means via said second guide.

18. A ribbon cassette usable for a first and a second ribbon of differing characteristics, said cassette including means enabling said cassette to be used with said first and second ribbons without modification of the cassette and wherein one of said first and second ribbons is a fabric ribbon and the other of said first and second ribbons is a film type ribbon, said means comprising a case having a ribbon inlet opening for said first and second ribbons, a ribbon outlet opening for said first and second ribbons, a ribbon storage chamber storing said first and second ribbons in a meandering state, said storage chamber having a downstream wall means, first slit means in said wall means for said first ribbon, a second slit means in said wall means for said second ribbon, said first slit means being spaced from said second slit means, first tensioning means juxtaposed to said first slit means for applying a load to said first ribbon as said first ribbon passes from said storage chamber, a guide for said first and second ribbons disposed downstream of said first and second slits, and second tensioning means for said first and second ribbons disposed juxtaposed to and upstream of said outlet opening means, whereby the same cassette is used for said first and second ribbons without modification of the cassette.

19. A ribbon cassette according to claim 18, wherein said guide is designated a first guide, further comprising a second guide for said second ribbon between said first guide and said second tensioning means, and further comprising a tape inverter means for said first ribbon between said first guide and said second tensioning means.

20. A ribbon cassette according to claim 18, wherein said first tensioning means comprises a rib.

21. A ribbon cassette according to claim 18, wherein said second tensioning means comprises a resilient pressing plate.

22. A ribbon cassette according to claim 19, wherein said first guide comprises a slit in a wall.

23. A ribbon cassette according to claim 19, wherein said second guide comprises a guide pin.

24. A ribbon cassette according to claim 18, wherein said first ribbon is a fabric ribbon.

25. A ribbon cassette according to claim 18, wherein said second ribbon is a film ribbon.

26. A ribbon cassette usable for a first and a second ribbon of differing characteristics, said cassette including means enabling said cassette to be used with said first an second ribbons without modification of the cassette and wherein one of said first and second ribbons is a fabric ribbon and the other of said first and second ribbons is a film type ribbon, said means comprising a case having a ribbon inlet opening for said first and second ribbons, a ribbon outlet opening for said first and second ribbons, a ribbon storage chamber storing said first and second ribbons in a meandering state, said storage chamber having a downstream wall means, first slit means in said wall means for said first ribbon, a second slit means in said wall means for said second ribbon, said first slit means being spaced from said second slit means, first tensioning means juxtaposed to said first slit means for applying a load to said first ribbon, a guide for said first and second ribbons disposed downstream of said first and second slits, and second tensioning means for said first and second ribbons disposed juxtaposed to and upstream of said outlet opening.

* * * * *